US005660018A

United States Patent [19]

Brodsky

[11] Patent Number: 5,660,018

[45] Date of Patent: Aug. 26, 1997

[54] FLOOR FOR COOLER AND METHOD OF INSTALLATION

[76] Inventor: Robert M. Brodsky, 6951 Ten Timbers La., Baltimore, Md. 21209

[21] Appl. No.: 629,541

[22] Filed: Apr. 9, 1996

[51] Int. Cl.[6] ..... E04G 23/02; E04B 1/64; E04B 1/66

[52] U.S. Cl. ..... 52/741.4; 52/741.3; 52/506.02; 312/400

[58] Field of Search ..... 312/400; 52/741.3, 52/741.4, 747.1, 506.02

[56] References Cited

U.S. PATENT DOCUMENTS 3,724,158 4/1973 Knecht ..... 52/741.4 X
3,991,252 11/1976 Kolakowski ..... 52/741.3 X
4,409,772 10/1983 Boyack ..... 52/741.4 X
4,873,807 10/1989 Filip ..... 52/741.4 X

*Primary Examiner*—Carl D. Friedman
*Assistant Examiner*—Yvonne Horton Richardson
*Attorney, Agent, or Firm*—Leonard Bloom

[57] ABSTRACT

A refrigerated cooler having a moisture proof, fungus proof floor disposed over an existing metal subfloor. The floor includes a plurality of rigid panels each coated to provide moisture resistance. The plurality of panels are precut and butted together to entirely cover the metal subfloor. A baseboard is disposed on the panels flush with the walls of the cooler. At least one coating of a sealant covers the baseboard and the panels. A layer of granular aggregate covers the coating on the baseboard and on the panels. A method for installing the floor sealing structure is disclosed.

15 Claims, 8 Drawing Sheets

FLOOR FOR COOLER AND METHOD OF INSTALLATION

FIELD OF THE INVENTION

The present invention relates to a moisture-proof, fungus-proof floor for a refrigerated cooler and a method of installation of the floor. More particularly, the invention relates to a plurality of panels which are secured to the metal floor of the cooler and are coated with a material which cures rapidly to a non-porous, non-slip surface.

BACKGROUND OF THE INVENTION

Refrigerated coolers such as are used for storing food in restaurants, supermarkets, hotels, butcher shops, hospitals and other businesses generally are made with metal floor. Over a period of time, the floors deteriorate due to popping of the rivets, corrosion and other problems. The deteriorated metal floor becomes a tripping hazard to employees and creates a sanitation problem. Dirt and bacteria accumulate in crevices and can contaminate the food stored in the cooler. Also, water leaking through the cooler floor can enter the area around the cooler and can also leak into the ceiling of the room below the cooler. The water has saturated the insulation below the floor of the cooler and has collected food particles, grease and dirt which spread through the area of leakage. If the leak damages the premises of another business, the owner of the cooler may be liable for damages.

U.S. Pat. No. 2,168,949 to Bertz et al discloses a stratiform structure, impervious to liquids and having a resistant surface, and consisting of a dry residue of an aqueous rubber dispersion mixed with a mineral cement, together with a rubber layer and a protective coating. The structure requires at least 24 hours to dry and set. U.S. Pat. No. 4,924,645 to Abeln discloses a composite floor structure and a process for the production thereof comprising a sheet piling metallic carrier section filled with sound proofing granular material (such as sand) on which an elastic deformable separating layer (such as felt) is placed. The composite floor is finished with a covering layer comprising anhydrite material. A skirting board is provided.

The problem of deterioration of metal floors of coolers has been known for many years and various approaches have tried to solve the problems. Most coatings do not remain intact on the metal floor for a variety of reasons, some relating to flexing of the floor and others relating to the inability of the coating to be effective at subfreezing temperatures. A further problem is the time required to install and cure a coating on a cooler floor. A method which can be completed in approximately eight hours and can be done during non-business hours is particularly useful.

There is a need for a floor which can be formed over an existing metal floor, which can be installed rapidly and can be ready for use within an hour after installation. The floor must be moisture proof, fungus-proof and provide a non-slip surface.

BRIEF SUMMARY OF THE INVENTION

It is an object of the present invention to provide a moisture-proof, fungus-proof floor which can be installed over an existing metal floor in a refrigerated cooler which operates at subfreezing temperatures.

It is a further object of the present invention to provide a floor which is rapidly installed and is available for use within one hour of the installation.

In accordance with the teachings of the present invention, there is disclosed a method of installing a moisture-proof, fungus-proof floor sealing structure over the existing metal floor of a refrigerated cooler. The cooler has vertical walls and is used for storing food in a restaurant, supermarket or other installation. The food is removed from the cooler prior to the installation of the floor sealing structure and the floor sealing structure is installed and cured overnight, thereby eliminating substantial downtime and consequent disruption in the operation of the restaurant or supermarket. The method includes the steps of providing pre-cut wood panels which are fully covered with a sealer, securing the pre-cut wood panels to the existing metal floor in the cooler to thereby provide a superfloor. A baseboard is constructed around the periphery of the superfloor and the joints between the baseboard and the superfloor and between the baseboard and the walls of the cooler, respectively, are sealed. At least one layer of a sealer is layed down on the superfloor. Granular aggregate is broadcast over the sealer layer while the layer is still tacky, thereby providing an attractive non-slip finish for the floor sealing structure.

Viewed from another aspect there is disclosed a refrigerated cooler having a moisture-proof, fungus-proof floor disposed over an existing metal subfloor. The cooler has vertical walls joining the metal subfloor. The floor includes a plurality of rigid panels, each coated to provide moisture resistance. The plurality of panels are precut and abutted to entirely cover the metal subfloor. The plurality of panels are secured to the metal subfloor. A baseboard is disposed perpendicularly to an upper surface of the plurality of panels, the baseboard being flush with the walls of the refrigerator. At least one coating of a sealant covers the baseboard and the plurality of panels. A layer of granular aggregate is adhered to and covers the coating of sealant on the baseboard and the plurality of panels.

These and other objects of the present invention will become apparent from a reading of the following specification taken in conjunction with the enclosed drawings.

DESCRIPTION

Figure 1:
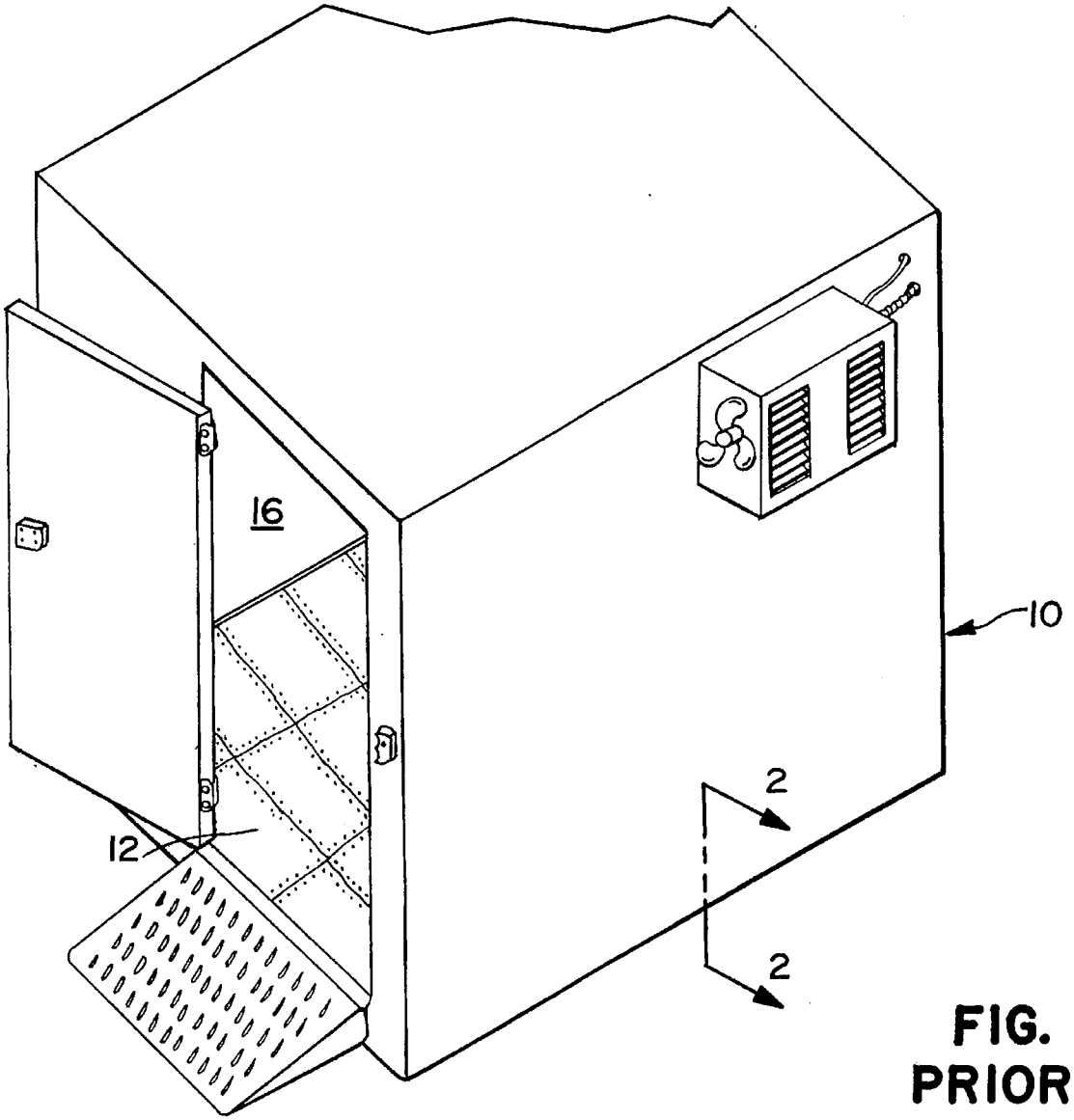
FIG. 1 PRIOR ART
FIG. 1 is a perspective view of a refrigerated cooler showing the deteriorated metal floor.
Figure 2:
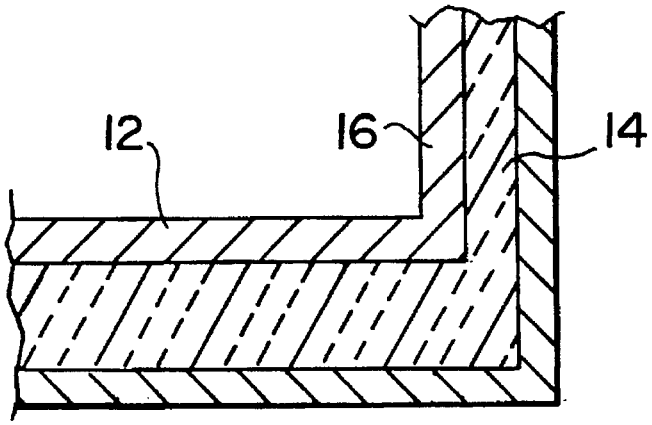
FIG. 2 PRIOR ART
FIG. 2 is a cross section taken along the lines 2—2 of FIG. 1 showing the metal floor and insulation adjoining the floor.

Referring to FIGS. 1 and 2, the refrigerated cooler 10 has an existing metal floor 12 which has deteriorated. The cooler 10 has insulation 14 under the floor 12 and adjacent to the walls 16. Due to leakage of water and accumulation of dirt through the damaged metal floor 12, the insulation 14 has become contaminated with water, grease, food particles and dirt which provides an environment for growth of bacteria and fungi. The water with the bacteria and fungi can then enter the floor around the cooler 10 and also leak into the ceiling of a room beneath the cooler 10.

The present invention discloses a floor sealing structure to install over the existing metal floor 12 to prevent leakage and to provide a non-slip surface for persons working within the cooler 10.

The installation of the floor sealing structure is initiated by removal of all the contents of the cooler 10 and cleaning of the walls 16 and metal floor 12 of the cooler 10. The dimensions of the metal floor 12 are measured exactly to the nearest ¼ inch because exact measurements are essential for a timely and successful installation. A diagram is made showing length and width with notations of any irregularities, protrusions, columns etc. All ramps and angles are accurately recorded. A plan of the floor is made laying out rectangles which are perpendicular to any seams in the existing metal floor 12. Numbers are assigned to the respective rectangles. A rigid material such as wood, and preferably plywood, is provided, although other materials to which the sealer adheres can be used. For use with a metal floor 12 which requires additional support, panels having a thickness of approximately ⅝–¾ inch should be used. Metal subfloors 12 with more stable surfaces should use panels having a thickness of approximately ⅜–½ inch.

Figure 3:
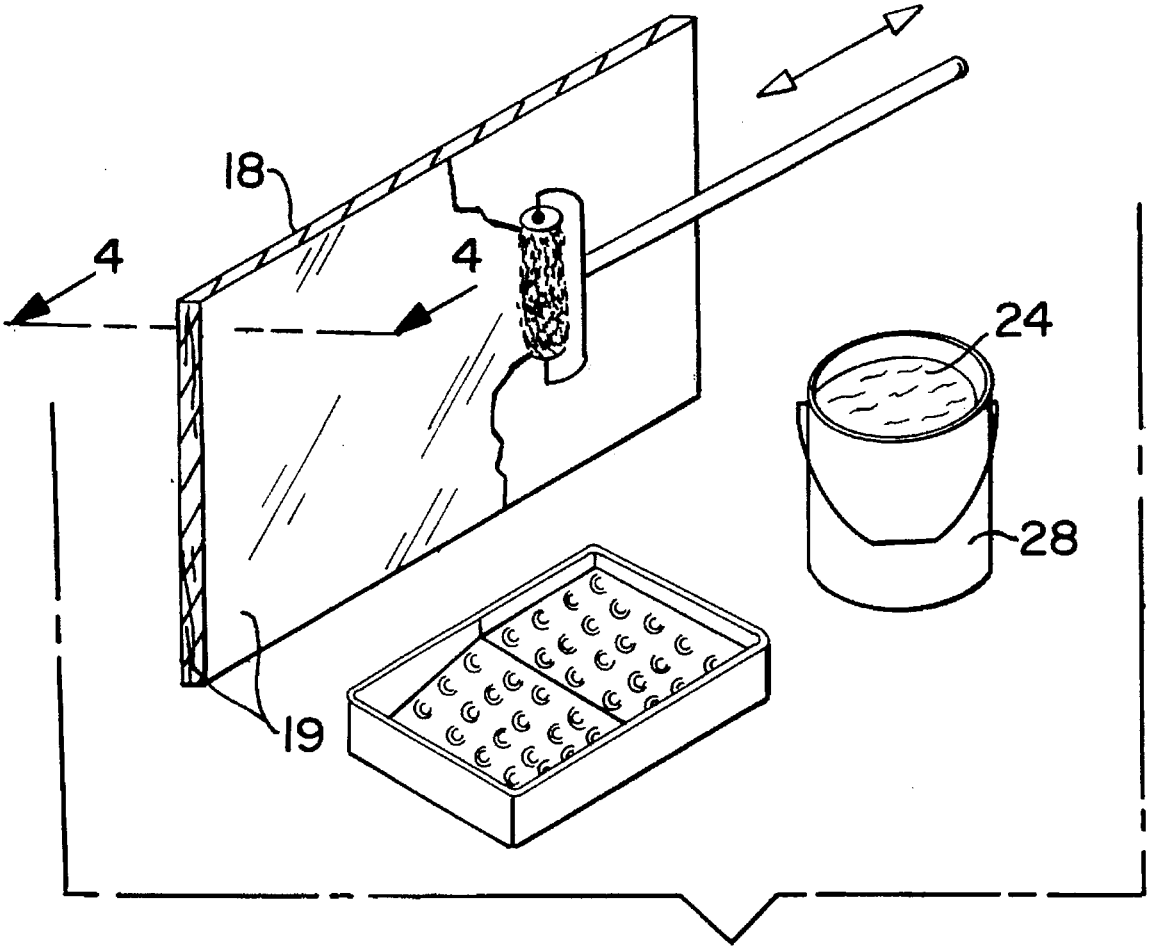
FIG. 3 is a perspective view showing the application of a moisture-proof coating to a precut panel.
Figure 4:
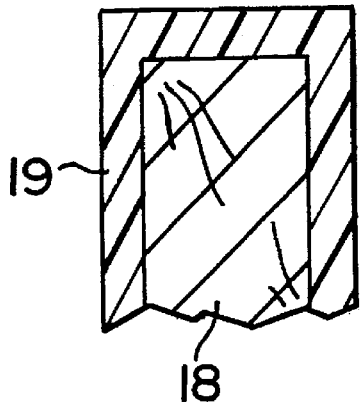
FIG. 4 is a cross section taken across the lines 4'4 of FIG. 3 showing coating on all sides and edges of the panel.

A plurality of rigid panels 18 are cut to the respective size as indicated on the diagram and are numbered to correlate with the diagram. All the sides and edges of each rigid panel 18 are coated 19 with a primer/sealer (FIGS. 3 and 4). It is preferred that the primer/sealer be substantially methyl methacrylate. A primer sealer which has been used satisfactorily is ROHALITH® #112 marketed by Stockhausen, Greensboro, N.C. This primer/sealer is applied at a rate of approximately 110 sq. ft. per gallon.

The coated rigid panels 18 are laid out on the metal floor 12 in numerical sequence such that the entire floor 12 is covered by the rigid panels 18 with the coated edges abutting one another. Gaps between the separate rigid panels 18 should not exceed ¼ inch. If any adjustments are required in which a portion of any panel is cut, the newly cut surface must be recoated with the primer/sealer. In this manner, a superfloor is formed over the metal floor 12.

Alternately, panels 18 having tongue and groove connections formed on the edges of the respective panels may be fitted together in a cooperating manner to cover the metal floor 12. This embodiment introduces additional costs, but reduces the possibility of a defective seam. Even if tongue and groove fitting is employed, the panels are still coated on all surfaces and all edges as described above.

Figure 5:
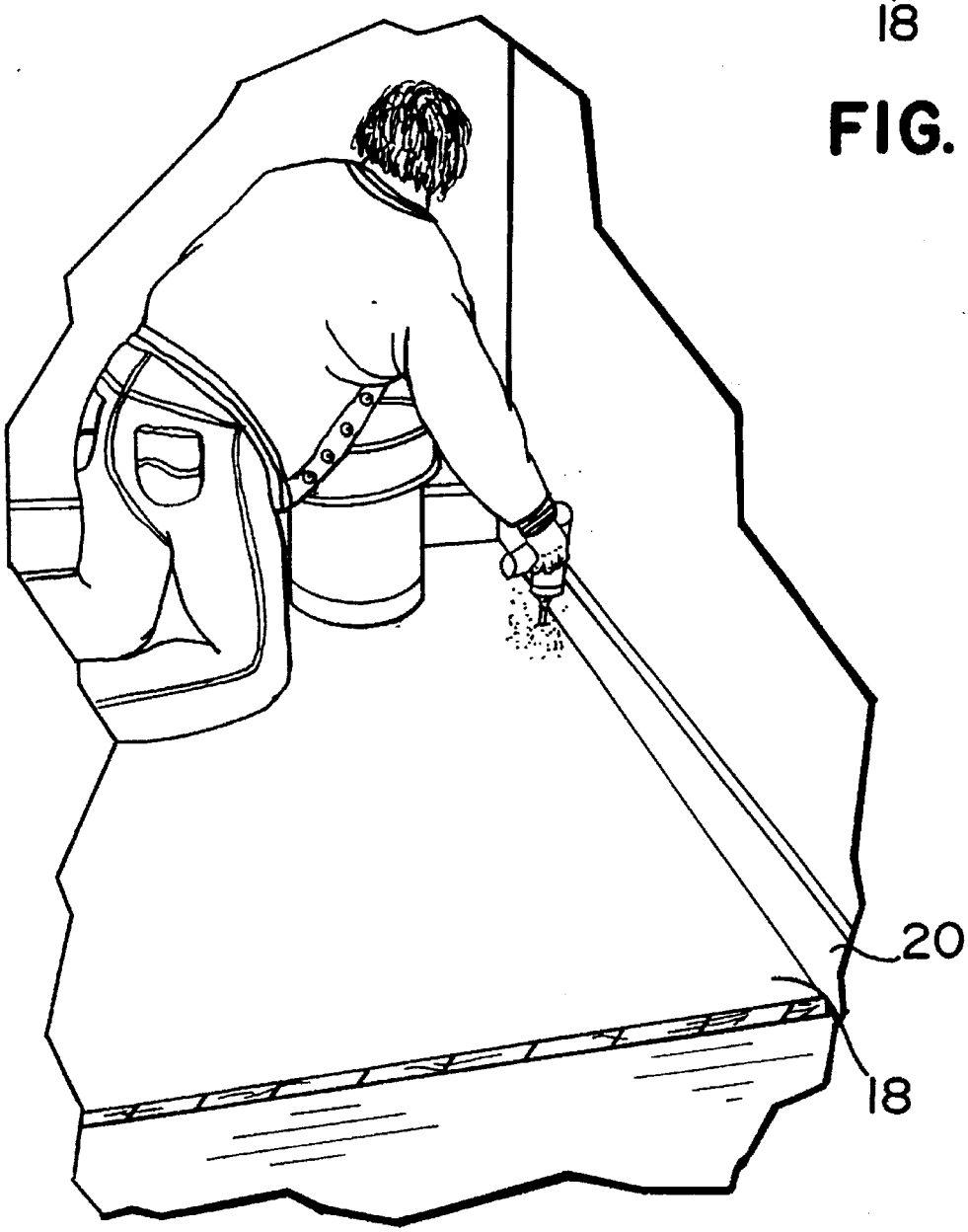
FIG. 5 is a perspective view showing the securing of the precut panels and the baseboard to the existing floor and walls of the cooler.

The rigid panels 18 are secured to the metal floor 12 (FIG. 5). Preferably, a plurality of spaced-apart holes are drilled through each of the rigid panels 18 and through the metal floor 12. Screws are disposed in each hole to secure the panels 18 to the metal floor 12. The head of each screw is flush with or slightly countersunk with respect to the upper surface of each panel 18. Alternately, adhesive or other means may be used to secure the plurality of panels 18 to the metal floor 12.

A baseboard 20 is placed around the periphery of the panels 18. Preferably, the baseboard 20 is disposed perpendicularly to the coated panels 18 and is flush with the walls 16 of the cooler 10. The baseboard 20 extends approximately 4 inches above the coated upper surface 19 of the panels 18. The baseboard 20 is formed from a plurality of segments of wood or material similar to the material forming the rigid panels 18 and are butted end to end around the periphery of the panels 18. The baseboard 20 is secured to the walls 16 of the cooler 10 in a manner similar to the securing of the panels 18 to the metal floor 12.

Figure 6:
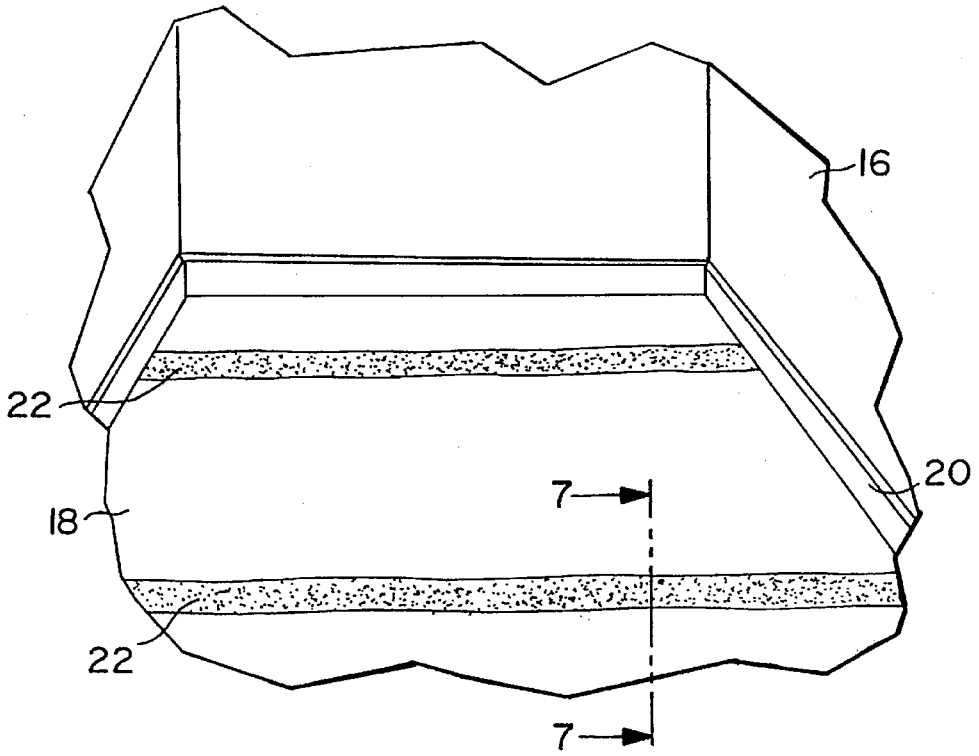
FIG. 6 is a perspective view showing coated fiberglass mesh disposed over the joints between the edges of adjacent panels.
Figure 7:
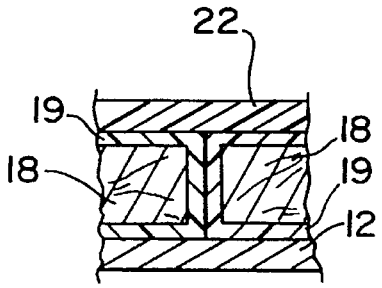
FIG. 7 is a cross section view taken along the lines 7—7 of FIG. 6 showing the fiberglass mesh disposed over the joints.
Figure 8:
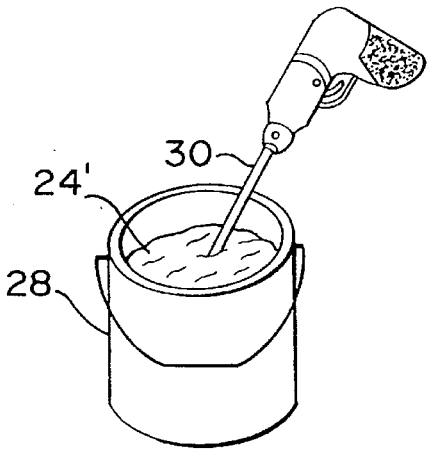
FIG. 8 is a perspective view showing mixing of the coating material in a container.
Figure 9:
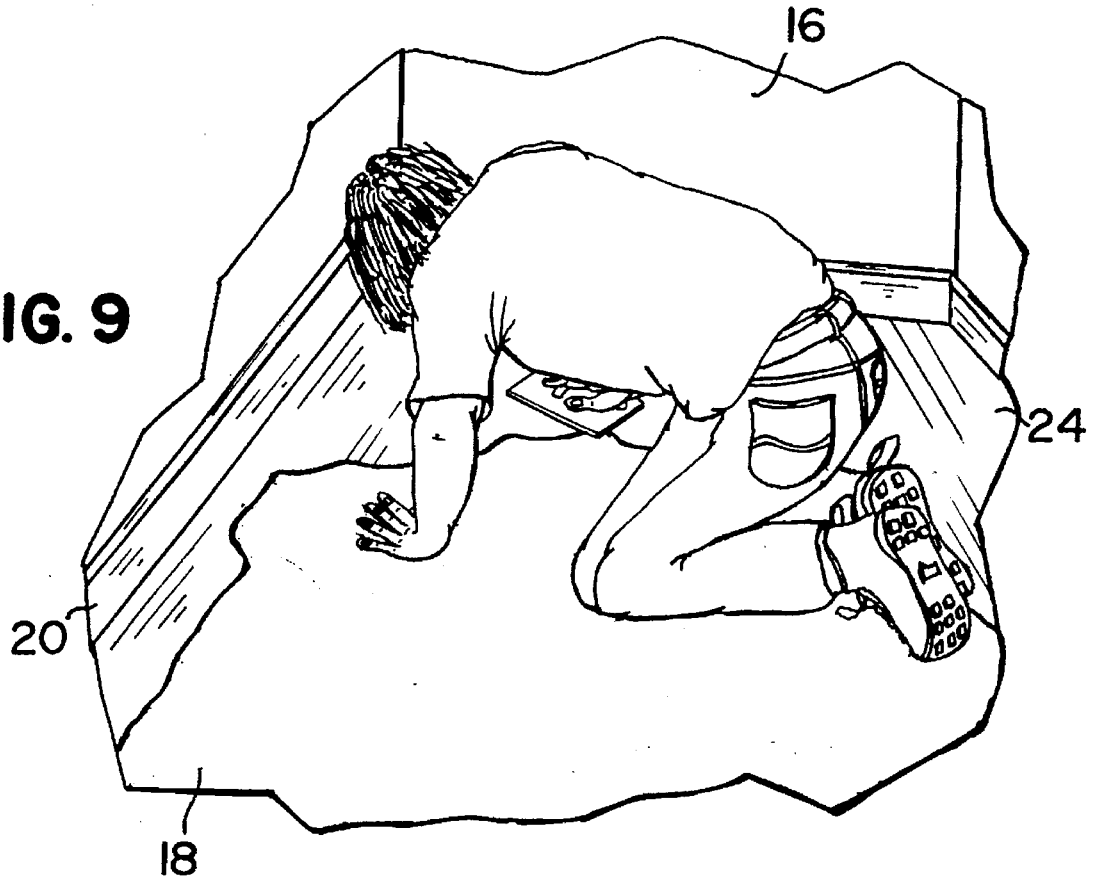
FIG. 9 is a perspective view showing application of the coating to the panels and the baseboard.
Figure 10:
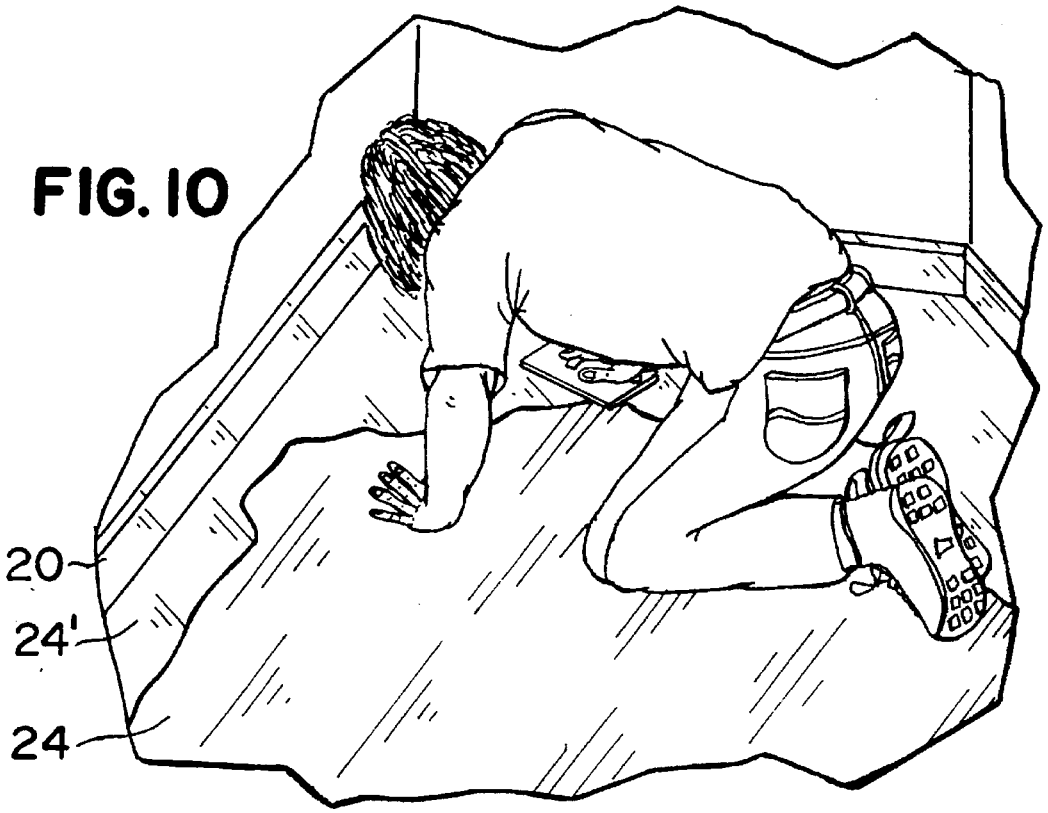
FIG. 10 is a perspective view showing the application of a second coating over the first coating.
Figure 11:
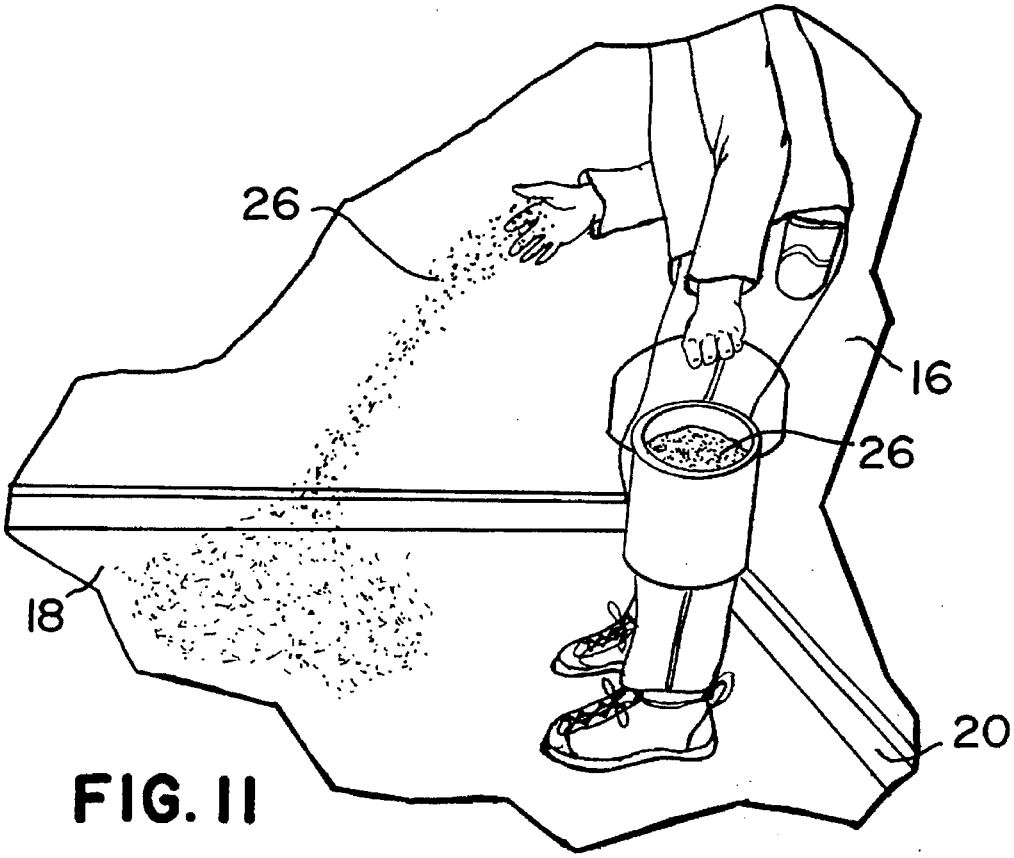
FIG. 11 is a perspective view showing the broadcast of aggregate over the coated floor and baseboard.
Figure 12:
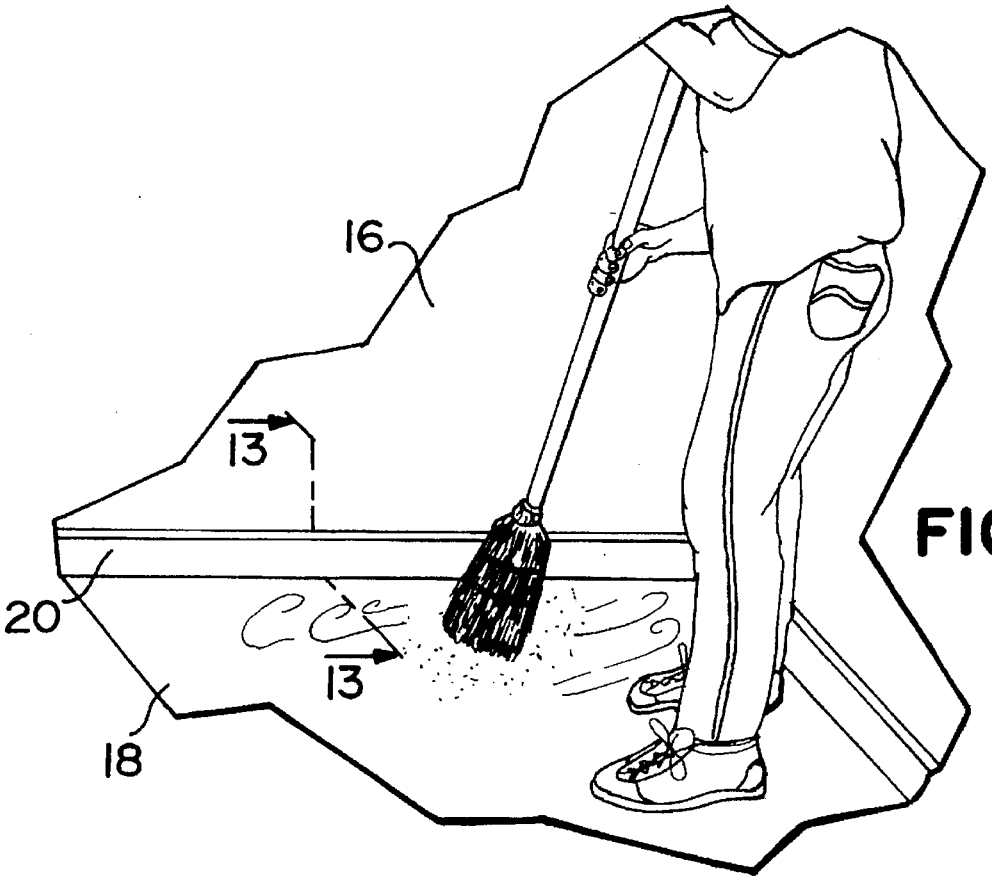
FIG. 12 is a perspective view showing removal of excess material from the coated floor.

A length of fiberglass mesh 22, approximately 6 inches wide is immersed in a container of sealant 24 and the impregnated mesh is placed over the butt joints between the rigid panels 18. The fiberglass mesh 22 is smoothed with a brush or roller to effectively prevent leakage through the butt joints and to provide additional structural support at the butt joints. It has been found that ROHALITH® #112 (as identified above) with 5–7% of a catalyst such as dibenzoyl peroxide is a satisfactory sealant 24 for use with the fiberglass mesh 22 (FIGS. 6–7).

The baseboard 20 is coated with the sealant 24 using a brush or roller and a mix of sealant 24' with granular aggregate 26 is prepared by mixing in a container 28 using a power-driven mixing blade 30. The sealant 24'/aggregate 26 mix is applied with a trowel to the vertical and horizontal portions of the baseboard, completely around the periphery of the panels 18. The mix generates heat and sets up as a hardened surface on the baseboard 20 and over the joint between the baseboard 20 and the panels 18. It is preferred that the sealant be substantially methyl methacrylate and ROHALITH® #172 has been found to be satisfactory. ROHALITH® #172 is marketed by Stockhausen, Greensboro, N.C. If desired, a pigment can be added to the mix to obtain a desired color.

If desired, a mix of sealant and silica sand powder is prepared and troweled onto the upper surface of the panels 18 to uniformly cover all of the panels 18. A spiked roller is rolled over the coating to provide an even surface and to remove trowel marks. ROHALITH® #151 has been used successfully as the sealer. This is substantially methyl methacrylate and is marketed by Stockhausen, Greensboro, N.C.

Granular aggregate 26 is broadcast over the entire surface of the panels 18. Any loose aggregate 26 is swept or vacuumed from the surface. The granular aggregate preferably consists of quartz particles which has a desired color (FIGS. 8–12).

A mix 24" of equal parts of the sealant 24 and a special sealer with approximately 2% by weight of a catalyst such as dibenzoyl peroxide is prepared. It has been found that sealant ROHALITH® #112 (as previously described) and special sealer ROHALITH® #151 are satisfactory. This mix is stirred by hand with a mixing stick. The mix is applied with a trowel to the upper surface of the panels 18 over the previously applied coatings.

If a smooth finish surface is desired, the coated panels 18 are sanded with sandpaper using a floor buffer. A second coating of sealant and special sealer, as above, is applied with a trowel.

A high quality clear caulk is applied to the top of the baseboard 20.

The cooler is available for use immediately after the caulking. No further waiting or cure time is required. The cooler can be adjusted to the desired temperature and contents of the cooler can be replaced.

The sealants used in the above process cure at temperatures from −14° F. to 95° F.

Figure 13:
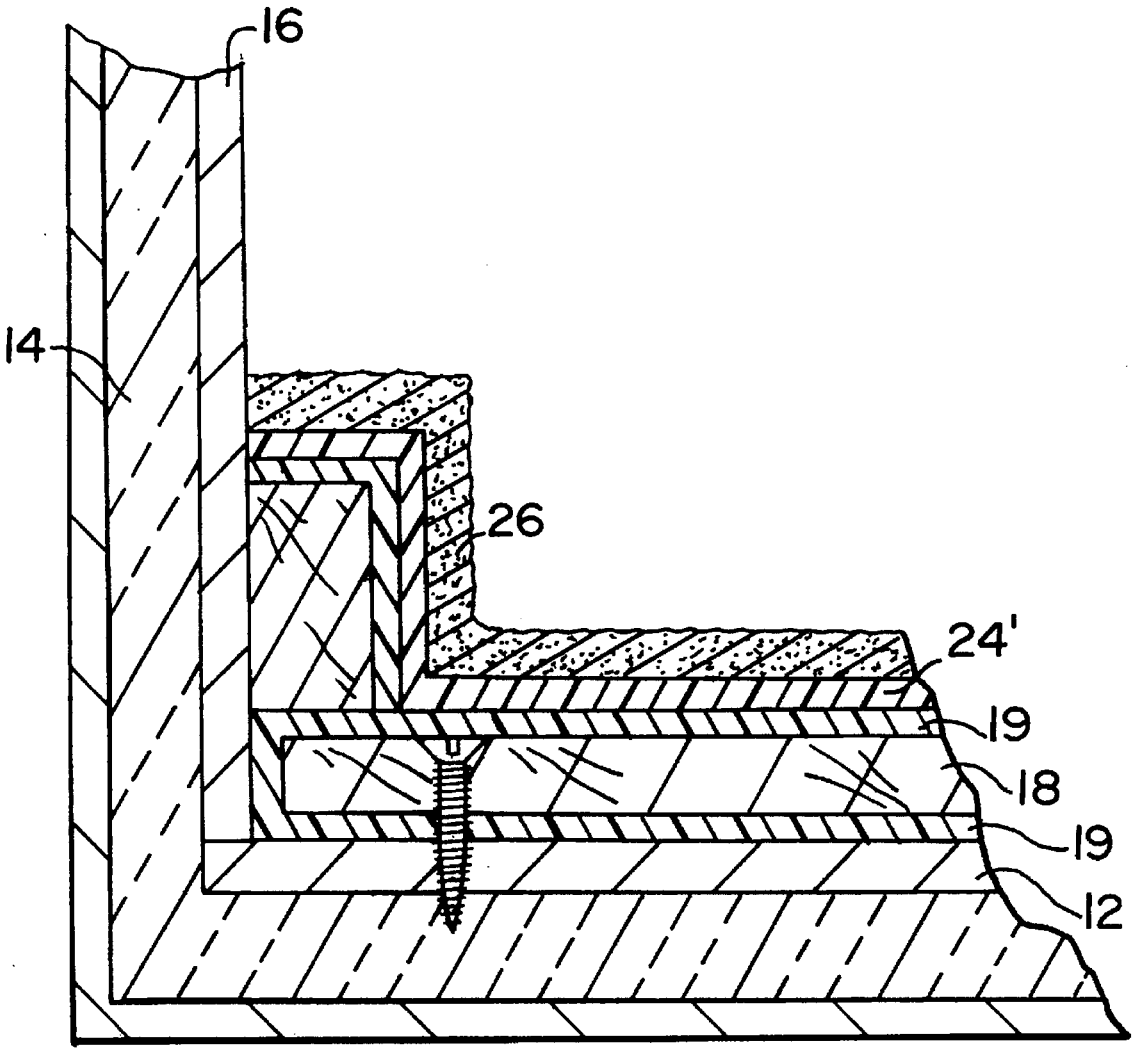
FIG. 13 cross sectional view across the lines 13—13 of FIG. 12 showing the multilayer coating on the panels secured to the metal floor of the cooler.
Figure 14:
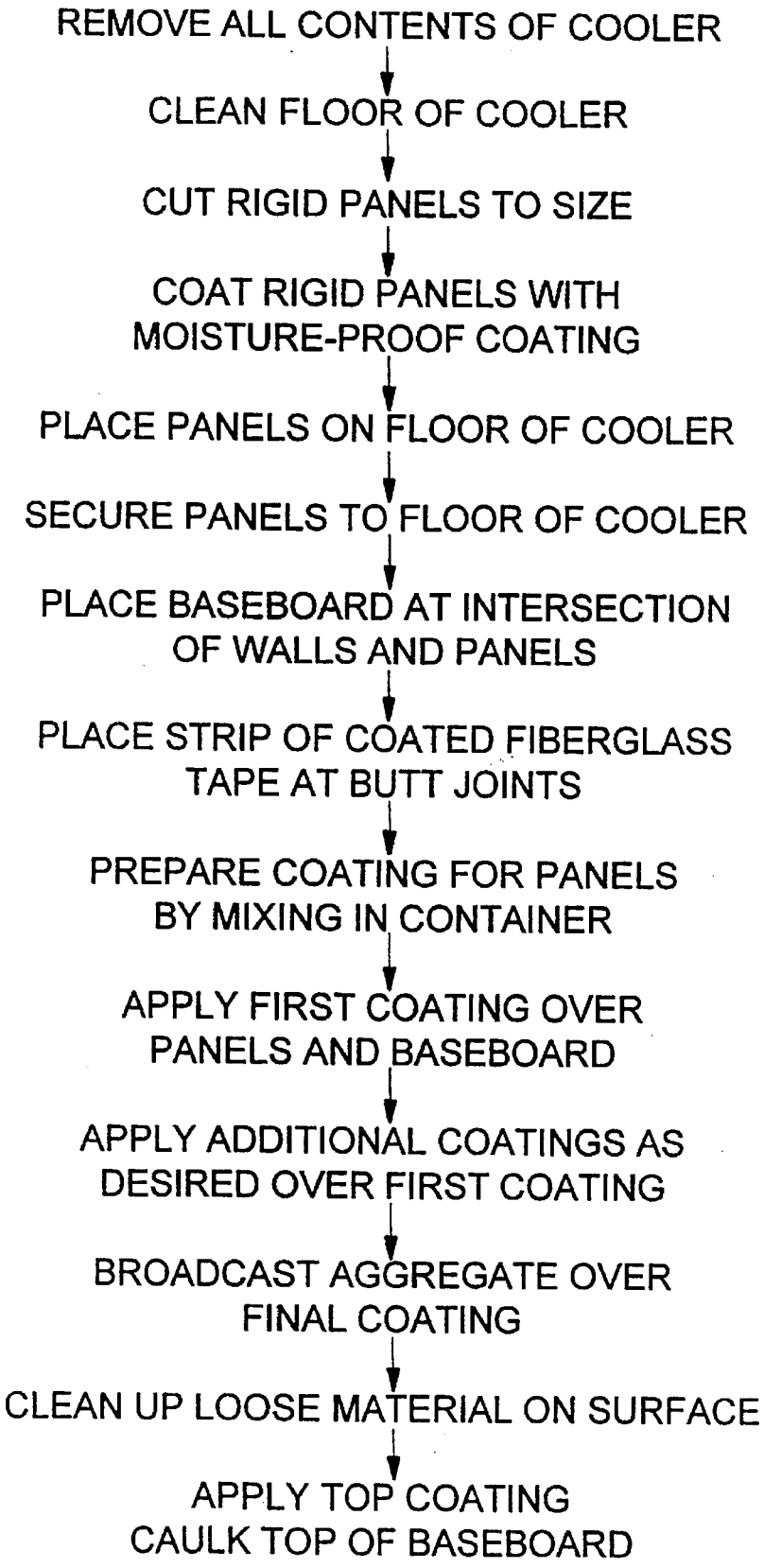
FIG. 14 s a diagrammatic chart showing the method of installing the floor sealing structure on the metal floor of the cooler.

By the above process, a refrigerated cooler 10 having a deteriorated metal floor 12 is repaired or retrofitted to produce a cooler 10 with a moisture-proof, fungus-proof floor. The floor has a plurality of rigid panels 18, each separately coated with a sealer to provide moisture resistance. The plurality of panels 18 are precut and abutted with one another to entirely cover the metal subfloor 12. The plurality of panels 18 are each secured to the metal subfloor 12, preferably with screws. A baseboard 20 is disposed perpendicularly to an upper surface of the panels 18 around the periphery of the cooler 10. A strip of fiberglass mesh impregnated with sealer is disposed at the abutment of each of the panels 18. At least one coating of a sealant 24 coats the baseboard 20 and the plurality of panels 18. A layer of granular aggregate 26 is adhered to and covers the coating on the baseboard 20 and plurality of panels 18 (FIGS. 13–14).

The floor of the present invention does not permit moisture to penetrate because of the method of coating the panels 18 and the nature of the acrylic coating. Also, the acrylic coating does not support the growth of fungus. The aggregate particles provide a non-slip surface for the floor of the present invention. The floor of the present invention is stable in a cooler operating at subfreezing temperatures.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. The method of installing a moisture-proof, fungus-proof floor sealing structure an existing metal floor of a refrigerated cooler, the cooler having vertical walls and being used for storing food in a restaurant, supermarket or other installation, wherein the food is removed from the cooler prior to the installation of the floor sealing structure, and wherein the floor sealing structure is installed and cured overnight, thereby eliminating substantial downtime and consequent disruption in the operation of the restaurant or supermarket, comprising the steps of providing pre-cut wood panels which are fully covered with a sealer, securing the pre-cut wood panels to the existing metal floor in the cooler to thereby provide a superfloor, constructing a baseboard around the periphery of the superfloor and sealing the joints between the baseboard and the superfloor and between the baseboard and the walls of the cooler, respectively, laying down at least one layer of a sealer on the superfloor, and "broadcasting" granular aggregate over the sealer layer while the layer is still tacky, thereby providing an attractive non-slip finish for the floor sealing structure.

2. The method of claim 1, wherein prior to laying down at least one layer of the sealer on the superfloor, further including the step of covering the joints between the edges of adjacent wood panels with a strip of fiberglass mesh which has been impregnated with the sealer.

3. The method of claim 1, wherein the granular aggregage is quartz particles.

4. The method of claim 1, wherein the sealer is an acrylic material.

5. The method of claim 4, wherein the sealer is at least 90% by weight methyl methacrylate.

6. The method of claim 1, wherein the installation is made in the temperature range of −14° F. to 95° F.

7. The method of claim 1, wherein the sealer cures within one hour and the cooler is available for use.

8. The method of claim 1, further comprising mixing a catalyst with the sealer prior to laying down the sealer on the subfloor.

9. The method of claim 1, wherein the precut panels have respective tongue and cooperating groove joints formed therein and the panels are interconnected.

10. A refrigerated cooler having a moisture proof, fungus-proof floor disposed over an existing metal subfloor, the cooler having vertical walls joining the metal subfloor, the floor comprising:

a plurality of rigid panels, each coated to provide moisture resistance, the plurality of panels being precut and abutted to entirely cover the metal subfloor, the plurality of panels being secured to the metal subfloor, a baseboard disposed perpendicularly to an upper surface of the plurality of panels, the baseboard being flush with the walls of the cooler, at least one coating of a sealant covering the baseboard and the plurality of panels, and a layer of granular aggregate adhered to and covering the coating of sealant on the baseboard and the plurality of panels.

11. The floor of claim 10, wherein the plurality of panels are secured to the metal floor by screws.

12. The floor of claim 10, wherein a strip of fiberglass mesh impregnated with sealer is disposed at the abutment of each of the plurality of rigid panels.

13. The floor of claim 10, wherein the sealer is at least 90% by weight of methyl methacrylate.

14. The floor of claim 10, wherein the panels are plywood.

15. The floor of claim 10, wherein two coatings of sealant cover the baseboard and the plurality of panels.

* * * * *